US007261374B2

(12) United States Patent
Potosky

(10) Patent No.: US 7,261,374 B2
(45) Date of Patent: Aug. 28, 2007

(54) ARM SUPPORT CUSHION

(76) Inventor: Denise Potosky, P.O. Box 871, 202 Overcreek Rd., Kimberton, PA (US) 19442

( * ) Notice: Subject to any disclaimer, the term of this patent is extended or adjusted under 35 U.S.C. 154(b) by 0 days.

(21) Appl. No.: 11/209,448

(22) Filed: Aug. 23, 2005

(65) Prior Publication Data

US 2006/0055215 A1 Mar. 16, 2006

Related U.S. Application Data

(60) Provisional application No. 60/603,864, filed on Aug. 24, 2004.

(51) Int. Cl.
*A47C 27/00* (2006.01)

(52) U.S. Cl. ..... 297/227; 297/411.46; 297/411.23; 297/188.18

(58) Field of Classification Search ..... 297/219.1, 297/227, 225, 440.11, 218.1, 452.58, 228.1, 297/188.18, 411.46, 41.23; 5/52, 655.9, 5/646, 652; 428/156, 158, 163, 167, 159, 428/160

See application file for complete search history.

(56) References Cited

U.S. PATENT DOCUMENTS 3,634,925 A * 1/1972 Van Loo ..... 29/458
3,884,495 A * 5/1975 Petock ..... 280/87.041
4,089,497 A * 5/1978 Miller et al. ..... 248/345.1
4,109,887 A * 8/1978 Wakeland, Jr. ..... 5/678
4,285,544 A * 8/1981 Zapf ..... 297/440.21
4,554,039 A * 11/1985 James ..... 156/213
5,239,717 A * 8/1993 Sue ..... 5/655
5,829,832 A * 11/1998 Molee et al. ..... 297/397
6,578,914 B2 * 6/2003 Artsvelyan ..... 297/219.1
6,604,789 B1 * 8/2003 Downing ..... 297/227
6,630,217 B1 * 10/2003 Jaaskelainen et al. ..... 428/36.9

* cited by examiner

*Primary Examiner*—David Dunn
*Assistant Examiner*—Erika Garrett

(57) ABSTRACT

An arm support cushion (38) that can be attached to the armrest of a chair is disclosed. The cushion elevates and supports the arm of any person desiring to lean on an armrest, including any person desiring to hold, nurse, feed, or cuddle an infant or young child. The cushion comprises a synthetic foam or appropriate material of adequate firmness that incorporates a passageway (14) along the bottom of the cushion, which accepts the armrest, and may include a fitted cover for the cushion. The passageway may include cuts, grooves, or channels (15) that allow the cushion to attach to armrests of varying widths. The cushion may pivot to accommodate the person seated, does not restrict the person's movement, and remains in place on the armrest without straps or fasteners. The cushion is portable, lightweight, and easy to remove and reposition on the armrest of a chair.

4 Claims, 3 Drawing Sheets

ARM SUPPORT CUSHION

CROSS-REFERENCE TO RELATED APPLICATIONS

This application claims the benefit of PPA Ser. No. 60/603,864 filed Aug. 24, 2004.

FEDERALLY SPONSORED RESEARCH

Not Applicable

SEQUENCE LISTING OR PROGRAM

Not Applicable

BACKGROUND OF THE INVENTION—FIELD OF THE INVENTION

This invention relates to the field of arm support cushions and methods for their use, specifically to support cushions designed to support the arm of a person who is seated in a arm chair, including arm support pillows used as nursing pillows when holding an infant or young child.

BACKGROUND OF THE INVENTION

Arm rest cushions are provided on an arm rest of a chair in order to provide comfort and support to individuals seated in the chair. Arm support cushions are particularly useful for persons who must sit in a chair for extended periods of time and who tend to lean on one arm of the chair or the other. The arm support cushion provides comfort and support by providing additional arm rest padding and by elevating the individual's arm as an aid to adjusting the posture of the seated person. For example, in one particular application, the arm support cushion may be useful in elevating and supporting a person's arm and maintaining the person's posture while the person is seated and holding, feeding, or interacting with an infant or young child.

In the example of the caregiver to a child, many people choose to sit in a rocking chair or arm chair when feeding or nursing a baby, and the baby's head may be rested in the bend of the feeder's arm while the rest of the baby's body rests on the feeder's lap. Supporting the baby's head in one's arm can become uncomfortable for the caregiver, especially if feeding is prolonged or occurs numerous times throughout the day. Some type of support is often needed to elevate the baby's head up towards the bottle or breast. While holding a baby or young child in a sitting position, the caregiver may lean on the arm rest of the chair, but the arm rest may be too low and/or too hard to provide comfort and adequate elevation to position the child. In addition, leaning on an arm rest that is too low distorts the seated posture of the seated individual, and over repeated and prolonged periods, this may cause shoulder, neck, and back discomfort.

Various attempts have been made to alleviate this discomfort to the seated individual. For example, a blanket or ordinary head pillow has been placed on the arm rest of the chair. However, these techniques are inadequate, since the blanket or pillow is too easily displaced due to arm movements of the seated individual and, when the seated individual is holding a child, to movements of the child. A variety of nursing pillows have been proposed for seated caregivers, including, for example, those described in U.S. Pat. Nos. 5,551,109; 5,661,861; 5,581,833; 5,519,906; and 6,763,539. However, these nursing pillows were designed to support the baby rather than the arm of the person holding the child. As a baby grows larger and heavier, it may become more difficult to position and support the child on such pillows, especially when the person holding the child is seated in a chair. Also, a blanket, ordinary head pillow, and even a nursing pillow resting on the lap of caregiver may fall or become displaced should the caregiver stand up or reposition the baby the on the other arm and side of the caregiver. An arm support cushion used when holding or nursing a baby or young child would adjust or pivot to accommodate movements of the caretaker's arm, but would also be easily removed and repositioned as needed.

In many instances, a caregiver holding a child has only one free hand or arm to position or to adjust a support cushion. Some pillows have been adapted to conform to the arm of the person holding a child, as in U.S. Pat. Nos. 5,239,717 and 6,381,786, which embed a pillow into a sleeve worn by the person holding the child. However, repositioning the child to the person's other arm or side may require removing and replacing the sleeve, which may be difficult to do with one hand while holding a child.

Other individuals may sit in a chair for extended periods of time. The armrests of various chairs are typically made of various hard materials and provide varying arm support and elevation. Extended seating while leaning on one arm rest of a chair or the other may cause fatigue, as well as arm, shoulder, neck, and back discomfort. Arm rest cushions have been proposed for lawn chairs, as in U.S. Pat. No. 5,048,892, stadium chairs, as in U.S. Pat. No. 5,700,053, wheelchairs, as in U.S. Pat. Nos. 5,060,638 and 5,429,416, and automobile arm rests, as in U.S. Pat. No. 5,979,987. In some cases, these arm rest cushions are designed to protect and pad a specific type of arm rest on a specific type of chair. Also, some of these applications are designed to position or even restrain the arm of the person using the arm support cushion in therapeutic settings. In most applications, arm rest cushions are designed to conform and adhere to the arm rest of a specific type of chair such that the cushion does not move easily. Preferably, an arm rest support cushion would focus more on the arm elevation, support, and comfort of the seated person and less on a particular type of arm rest or chair, and would move or pivot on the arm rest of the chair as the seated person leaned his or her arm on the cushion.

Some arm rest cushions, as in U.S. Pat. Nos. 6,578,914 B2 and 5,605,374, are comprised of various straps, clips, or other mechanisms used to affix and stabilize the arm support cushion to the chair. Because such cushions rely upon straps or attachments rather than the design of the cushion in order to adhere to the arm of the chair, such cushions do not pivot easily to adjust to the natural movements of a seated individual and are not easily removed or repositioned on the other arm rest of the chair.

BRIEF SUMMARY OF THE INVENTION

Because of the foregoing problems and drawbacks of existing arm support cushions, it is desirable to have an improved arm support cushion that provides comfort, elevation, and support to a seated caretaker of an infant or young child, and to other seated individuals. The arm support cushion of the present invention provides comfort, arm elevation and support to a seated person, and does so in a way that is more convenient and comfortable to the person. One advantage of the present invention over prior art is that it relies upon its generally M-shaped cross-sectional form to attach to the arm rests of several styles of chairs without straps or rigid fasteners. Also, the form of the cushion of the present invention allows the cushion to move or pivot to conform to the movements of the seated individual. One other advantage of the present invention is that the cushion can be positioned on either arm rest of a chair as needed, but the cushion is also light and easily detached and replaced on one or the other arm rest of a chair as may be desired.

This invention is related to other types of support pillows that may be used to facilitate holding and feeding a baby, among other uses for support pillows designed to support the arm of a person who is seated in an arm chair. In one embodiment, the invention provides an arm rest support cushion that comprises an adequately firm cushion body that attaches to the arm rest of a chair such as a rocking chair. The size and shape of the cushion, which includes a passageway centered lengthwise on the bottom side of the cushion, allows the cushion to attach to the arm rest of the chair and to provide adequate elevation and support to the arm of person seated in the chair. The cushion is easily removed and repositioned on either arm rest of the chair. In addition, cuts, grooves, or channels in the passageway, which may be cut, shaped, assembled, or molded into the cushion, enables the cushion to pivot on the arm rest of the chair in accordance with the movement of the arm of a person seated in the chair. The cross-sectional perspective of the overall cushion may generally resemble a modified "M" shape. Alternative embodiments of the cushion may suggest other cross-sectional shapes. The foregoing description is intended only to illustrate the preferred embodiment of the present invention, and does not serve to limit the invention in any way.

The primary object of the proposed invention is to provide arm elevation, support, and comfort when needed, without restricting the movement of a seated person or of a child that the person may be holding. The proposed invention provides an arm support cushion that is portable, lightweight, and easy to remove and reposition on either arm rest of a chair. The cushion remains in place on the arm of the chair, and also pivots during use.

DRAWINGS—FIGURES

In the drawings, closely related figures have the same number but different alphabetic suffixes.

DRAWINGS—REFERENCE NUMERALS

11 length of cushion

12 depth or thickness of cushion

13 width of cushion

Figure 1A:
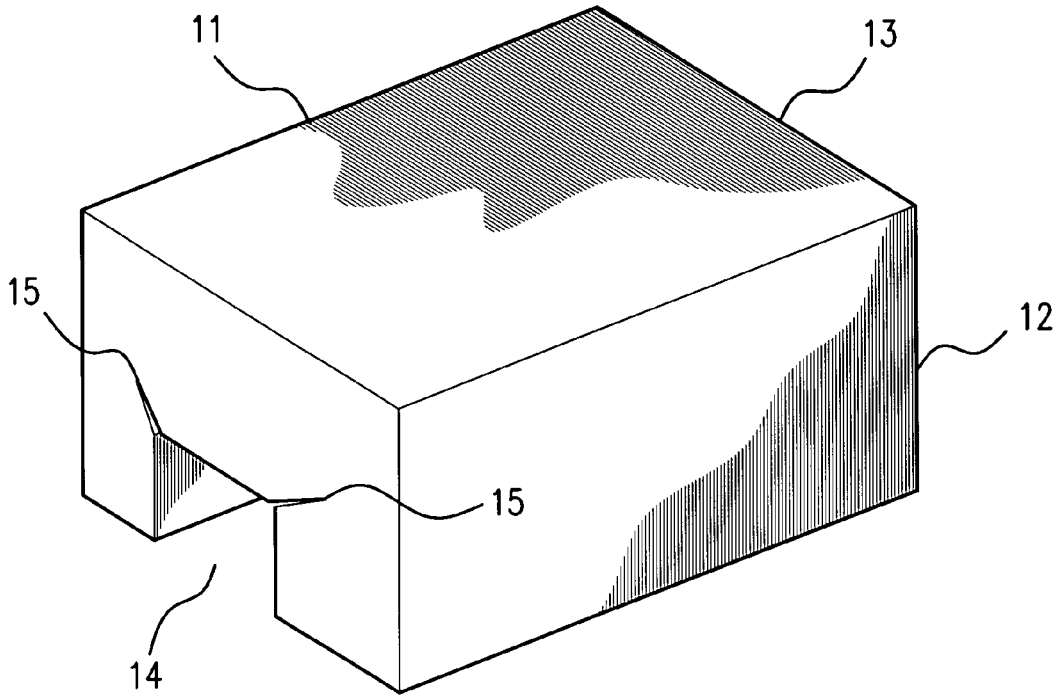
FIG. 1A shows a top, front, and side perspective view of a preferred embodiment of the cushion of the present invention.

14 passageway centered along bottom-side of cushion

15 cuts, grooves, or channels along the inside of the passageway of the cushion

16 alternative shaped edges of cushion

17 alternative contoured depth or thickness of cushion

18 alternative shaped corners of cushion

19 alternative contoured top of cushion

20 alternative angled passageway centered along bottom-side of cushion

21 alternative inner cuts or channels along the inside of passageway

22 portion of cover for inner passageway and a portion of front and back of cushion

23 portions of cover for front and back of cushion

24 portion of cover for top, sides, bottom, and inner sides of passageway of cushion

35 arm rest of chair

36 passageway of cushion as shown on arm rest of chair

37 arm of person holding a young child while leaning on cushion

38 cushion, shown pivoting inward and supporting person's arm

39 strap with watch attached to cushion cover as an example peripheral item

40 arm of seated individual who is leaning on cushion

41 cushion, shown elevating person's arm

42 pocket as an example peripheral item attached to side of cushion

DETAILED DESCRIPTION—FIG. 1-A—PREFERRED EMBODIMENT

FIG. 1A is a top, front, and side perspective view of a cushion constructed in accordance with the invention. Ideally, the "predetermined length" of the cushion of the present invention means between one-half the length up to the full length of the arm rests of most chairs. The preferred embodiment of the cushion of the present invention is sized to be approximately ten to twelve inches in length 11, which is approximately two-thirds the length of the arm rests of most standard rocking chairs and other chairs with arm rests. Ideally, "ample depth and width" for the cushion of the present invention means thick enough 12 and wide enough 13 to accommodate a passageway 14 in the bottom portion of the cushion that is deep enough to enable the cushion to attach to the arm rest of the chair, as well as thick enough 12 to provide comfort and adequate elevation and support for an arm of a person who is seated in the chair. For example, the thickness 12 of the cushion will provide comfort and elevation to the arm of a person who is holding a child while seated in the chair. By elevating a person's arm, the cushion may help to maintain adequate posture of the person, which may reduce neck and back strain over extended periods.

The cushion should not be so wide 13 as to restrict the movement of the person seated in the chair. Preferably, the depth or thickness 12 of the cushion ranges between approximately five to seven inches thick, and the width 13 of the cushion ranges from approximately seven to ten inches wide. For example, a thickness of approximately five inches may allow for an adequately deep passageway that is cut, shaped, assembled, or molded into the bottom side of the cushion, and also approximately three inches of cushioning material on the top side of the cushion for the adequate elevation and support of a person's arm.

The passageway 14 is the means for the cushion to attach to and pivot on the arm rest of a chair. "Adequately wide" means that the passageway opening on the bottom-side of the cushion may vary according to the width of most arm rests. For example, a cushion width 13 that is approximately eight inches wide may permit an approximately one and one-half to two and one-half inch wide passageway 14 that is approximately two inches deep to run lengthwise along the bottom side of the cushion to attach to the arm rest of a chair. "Contoured to attach the cushion" to the arm rest means that the passageway may be cut out or shaped to be parallel or straight into the cushion 14, or it may be angled or curved to accommodate various styles of arm rests on various types of chairs. In addition, the passageway may include cuts, grooves, or channels that run along the inside of the passageway. For example, an approximately one inch long inner cut, groove, or channel 15 on each side of the passageway 14, may allow the cushion to expand to accommodate varying arm rest widths on several different types of chairs. The inner cuts 15 shown on each side of the inner portion of the passageway 14 may also allow the cushion flexibility to pivot when the person seated in the chair leans on the cushion.

The preferred embodiment of the arm rest support cushion that is shown in FIG. 1A is made of a "configured synthetic foam material or assembly" that is cut, shaped, assembled, or molded to conform to the specifications described above. The synthetic foam material or assembly should be adequately dense or firm to provide the thickness 12 and the passageway 14 as described above. The "predetermined cross-sectional shape" of the preferred embodiment of the cushion, with the passageway 14 and the additional cuts or channels 15 beyond the passageway 14, as described above, may form a general shape like a modified "M" shape. This general cross-sectional shape may be altered to various aesthetic, comfort, or arm rest size and shape considerations.

Figure 1B:
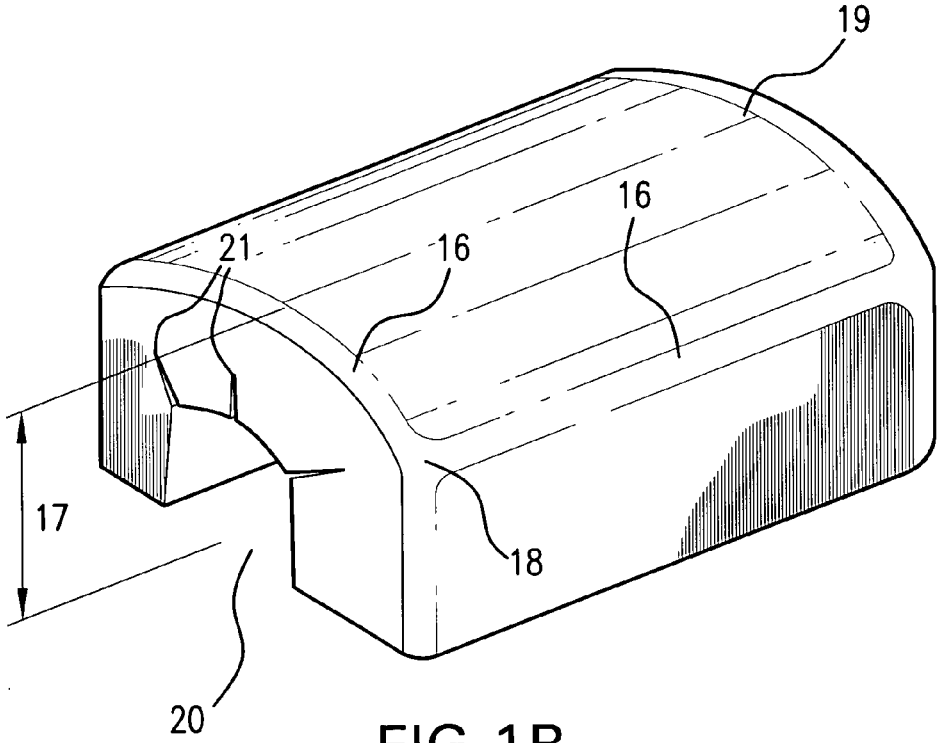
FIG. 1B shows a top, front, and side perspective view of an alternative embodiment of the cushion of the present invention.

FIG. 1B—Additional Embodiments

The outside edges and corners of the cushion may be squared, rounded, or otherwise shaped to conform to varying aesthetic and comfort specifications. The length, width, thickness, and general contour of the cushion as well as the width, depth, and shape of the passageway may be modified to accommodate arm rests of varying sizes and shapes. Alternative cuts, grooves, or channels may be made in addition to or in place of the side cuts or channels 15 on the inner portion of the passageway in order to modify the cushion for other arm rests, such as wheel chairs or other seats or chairs with arm rests. Also, the top or side portions of the cushion may be contoured to be concave or convex to accommodate the arm or side of a seated individual. The overall shape of the corners, edges, top, and side portions of the cushion of the present invention are not limited to block-like shapes, but may be rounded or shaped in a variety of ways.

FIG. 1B is a top, front, and side perspective view of an alternative embodiment of the cushion of the present invention, and it provides an example of possible shape or contour modifications to the edges 16, thickness 17, corners 18, and top 19 of the cushion, as well as an alternative shape or configuration of the passageway 20 and an alternative inner cuts or channels 21 along the inner portion of the passageway 20. For example, FIG. 1B shows beveled edges 16 and corners 18, and a more rounded shape to the top 19 of the cushion, which may be created by a contoured thickness 17. As an example of how the passageway can be modified, the passageway 20 shown in FIG. 1B has been angled to provide a slightly larger opening at the bottom of the cushion in order to accommodate an arm rest of a chair that is wider where the bottom of the cushion may be positioned. FIG. 1B also shows alternative cuts or channels 21 along the center of the passageway 20 to enable the cushion to accommodate an arm rest of a chair that may be wide or padded at the top. As in the preferred embodiment, the modified passageway 20 and cuts 21 may enable the alternative embodiment to pivot along the arm rest of a chair.

FIG. 2—Cover

Figure 2:
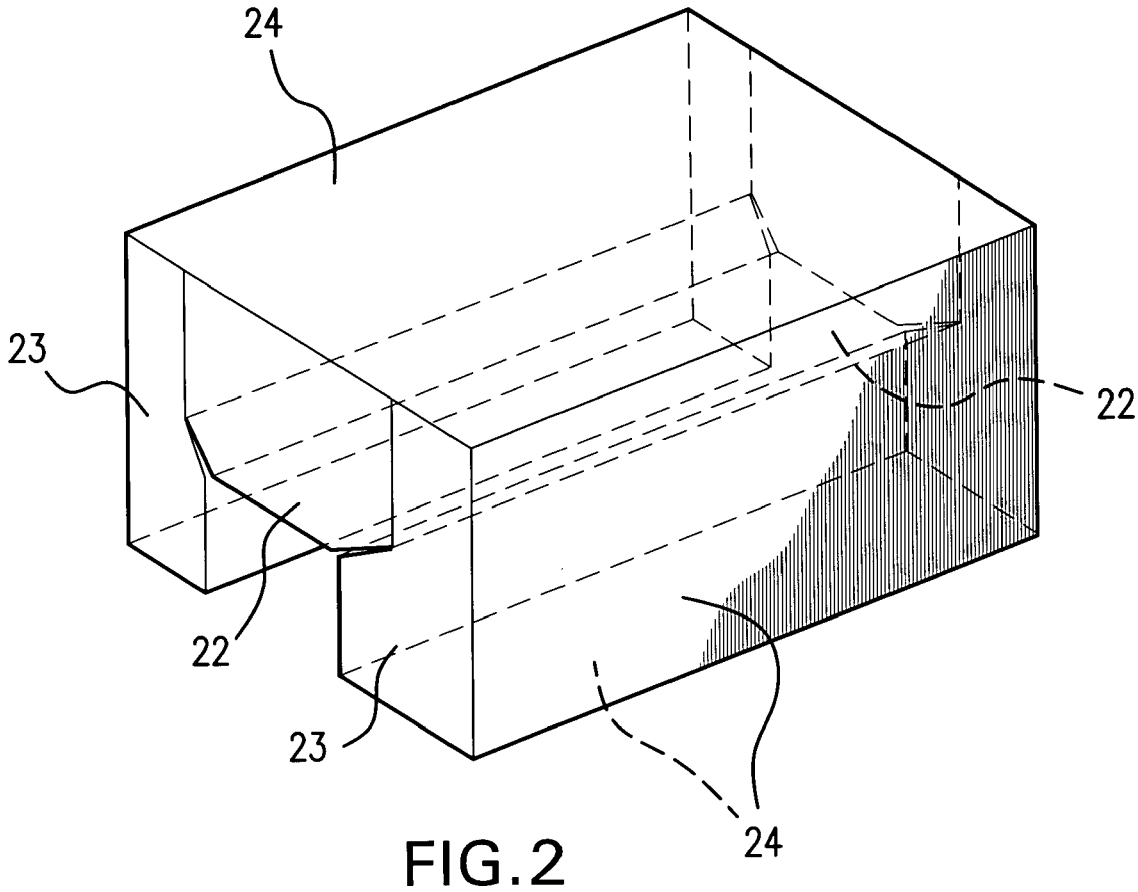
FIG. 2 shows a top, front, and side perspective view of a possible cover to protect and/or give shape to the cushion of the present invention.

Because synthetic foam cushioning material may fade or deteriorate over time, a cover for the preferred embodiment made of suitable fabric or other suitable material is recommended. The cover shown in FIG. 2 may be constructed of any suitable fabric or other suitable material that has been cut and sewn or otherwise put together as a means of covering the preferred embodiment of the cushion. Ideally, this cover may be fitted to the general shape of the cushion. FIG. 2 is a top, front, and side perspective view of an embodiment of the cushion of the present invention, and it provides an example of possible options for fitting a cover to the cushion. A portion of this cover covers the inner passageway and extends up the front and back sides of the cushion 22. Smaller pieces 23, which may be generally "L" shaped, cover the portions of the front and back not covered by the passageway portion 22. The top, sides, bottom, and inner sides of the passageway may be covered by another portion 24 of the cover assembly.

The cover assembly may also be used as a means of maintaining the general shape of the invention. Specifically, the cushion of the present invention may be comprised of a cover assembly that conforms to the general shape of the invention and that may then be filled with an appropriate fill material such as synthetic foam material or batting which can be of different grades and qualities to provide adequate firmness and shape to the cushion. The cover assembly may also be comprised of an inflatable material and then filled with air or with an appropriate fluid to provide adequate firmness and to create the general shape of the cushion. In these examples, the assembled cover, filled with a suitable material, may create the shape and functionality of the cushion of this invention, including the passageway 14 and 20.

Figure 3:
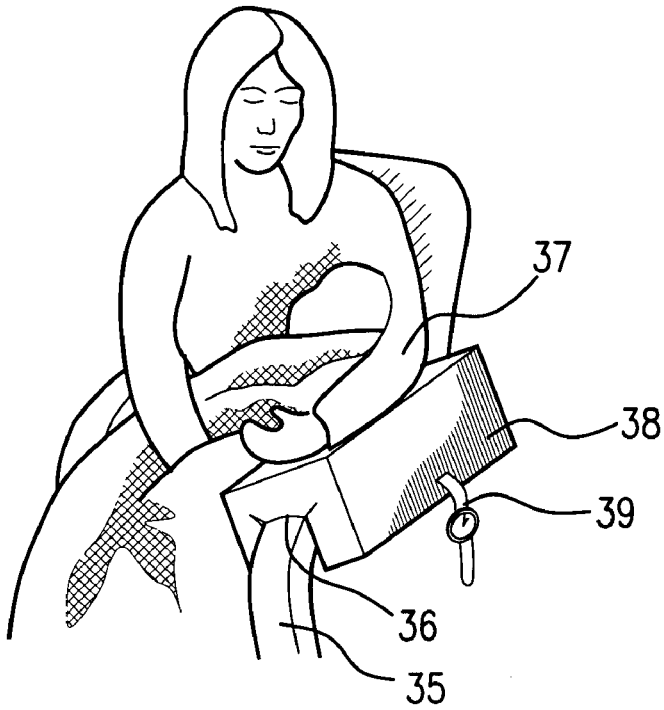
FIG. 3 shows a view of the cushion mounted on the arm rest of a chair when a caregiver's arm is resting on the cushion.

The material used to cover the cushion of the present invention may be plain, printed, decorated, or embellished with, for example, eyes and ears to depict animals or characters similar to those used to decorate a nursery room. In addition to decorative embellishments to the cushion or its cover, peripheral items such as but not limited to pockets of varying sizes and straps that hold articles such as a watch or pacifier may be attached to the cushion or the cover of the cushion. FIG. 3 shows an example of one possible peripheral item, a strap 39 to which a watch is attached, and FIG. 4 shows an example of another possible peripheral item, a pocket 42 attached to a side of the cushion.

Figure 4:
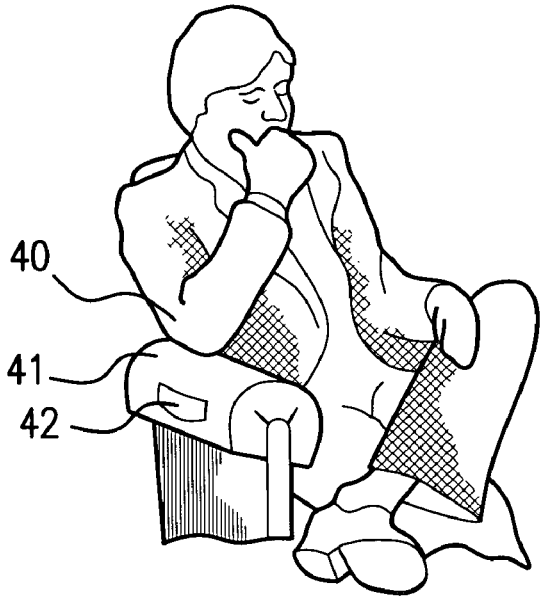
FIG. 4 shows a view of the cushion mounted on the arm rest of a chair when a seated person is leaning an arm on the cushion.

FIGS. 3-4—Operation

FIG. 3 shows the cushion mounted on the arm rest of a chair while a person who is holding a child is seated in the chair and is using the cushion. In use, the cushion is placed on the arm rest of a chair in the manner shown in FIG. 3. The cushion will attach to the chair's arm rest 35 by positioning the passageway 36 along the arm rest. The passageway 36 will permit the mounted cushion to conform to arm rests of varying widths, and the form of the passageway 36 will allow the cushion to pivot in order to adjust to the caregiver's position when the caregiver leans his or her arm 37 on the cushion. In the case of this invention, to "pivot" on the arm rest of the chair means that the cushion 38 will move or slope, typically inward, to provide comfortable support and elevation to the arm of the person seated in the chair. The extent to which this pivot occurs is intended to vary depending on the design of the chair and size and shape of the arm rest, the height and movement of the person seated in the chair, and the amount of weight the person applies to the cushion while leaning on the cushion, among other things. Ideally, the cushion will pivot no more than approximately forty-five degrees. The cushion elevates and supports the person's arm 37, as needed when the person is comforting, rocking, or nursing an infant or young child. Should the caregiver change positions or stand up, the cushion will remain on the arm rest of the chair. However, because the cushion is light weight and is not securely strapped, clamped, or otherwise firmly fastened to the chair, the caregiver can easily lift the cushion from the arm rest of the chair for transport or for relocation of the cushion on the opposing arm rest of the chair.

FIG. 4 shows an alternative embodiment of the cushion 41 mounted on the arm rest of a chair while a person is seated in the chair and is using the cushion. The cushion 41 pivots slightly to adjust to the position of the seated individual when the individual leans his or her arm 40 on the cushion 41. The cushion elevates and supports the person's arm 40, and as a result the person's general posture while seated is upright and comfortable.

CONCLUSIONS

The cushion of the present invention provides desirable elevation and appropriate support to the arm of a person who is seated in a chair. The arm support cushion of this invention enhances a person's comfort and helps to maintain adequate posture when the seated person leans to one side and uses the cushion. The cushion is configured of adequately firm synthetic foam or other suitable material that can be shaped to incorporate a passageway along the bottom side and adequate thickness on the top side of the cushion. A person using the cushion of the present invention places the cushion on the arm rest of a chair by aligning the passageway along the length of the arm rest of the chair. The cuts, grooves, or channels that are incorporated into the passageway enable the cushion to conform to arm rests of varying widths. The general shape of the passageway and the cuts, grooves, or channels along the passageway may also enable the cushion to pivot appropriately when a person is seated in the chair and leans on the cushion.

The cover of the cushion of the present invention may be comprised of fabric or other suitable material, and the cover may help to protect or maintain the shape of a cushion made of synthetic foam or other suitable material. In addition, the cover of the cushion may be assembled and then filled to adequate firmness with any suitable material to comprise the general shape of the cushion. A variety of peripheral items and embellishments may be attached to the cover in order to enhance its appearance and its usefulness.

The arm support cushion of the present invention may be especially helpful to a person who is seated and holding, nursing, or feeding an infant or young child. The cushion remains in place on the arm rest of the chair, provides elevation, comfort and support when needed, moves or pivots appropriately, but does not restrict the movement of the person or the child. The elevation and support for a person's arm and the comfort provided by the cushion of the present invention is not limited to caregivers, but extends to any other seated individual seeking arm support and comfort. The cushion is portable, lightweight, and easy to remove and reposition on either arm rest of a chair.

Although the description above contains many specifications, these should not be construed as limiting the scope of the invention but as merely providing examples of some of the presently preferred embodiments of the cushion of the present invention. Thus the scope of the invention should be determined by the appended claims and their legal equivalence, rather than by the examples given.

I claim:

1. A cushion for attachment to an armrest of a chair comprising: a removable device that is of predetermined length relative to the armrest, said device having ample depth and width as a means of providing elevation and support for an arm of a person seating in said chair, and a means for said device to attach to said armrest and to allow said device to armrest comprising a passageway having a predetermined cross-sectional shape that is cut, shaped, assembled or molded into said device, said passageway being centered along the length of said cushion, said passageway including to upper corners, said means comprising a plurality of inner cuts extending in a diagonal direction from the upper corners of the passageway that enable pivotable movement along said armrest of said chair and that allow said cushion to expand to accommodate varying said armrest widths; wherein the device comprises a synthetic foam, assembly, or fill material enclosed in a cover assembly to incorporate said passageway and said cuts.

2. The cushion of claim 1 wherein said passageway is wide and contoured to removably and pivotably attach said cushion to said armrest of said chair, whereby said passageway is cut, shaped, assembled, or molded into a firm and lightweight material.

3. The cushion of claim 1 wherein said passageway includes one or more additional cuts, grooves, or channels that run along said passageway, whereby said cuts, grooves, or channels enable said cushion to be pivotably mounted on said armrest of said chair.

4. The cushion of claim 1 further includes a cover assembly comprising fabric or other material put together as a means of covering the cushion and maintaining the shape of the cushion.

* * * * *